US008382497B2

(12) United States Patent
Huang

(10) Patent No.: US 8,382,497 B2
(45) Date of Patent: Feb. 26, 2013

(54) POWER OUTLET WITH SHIELD LOCKING MECHANISM

(76) Inventor: Huadao Huang, Yueqing (CN)

( * ) Notice: Subject to any disclaimer, the term of this patent is extended or adjusted under 35 U.S.C. 154(b) by 0 days.

(21) Appl. No.: 13/249,882

(22) Filed: Sep. 30, 2011

(65) Prior Publication Data

US 2012/0083142 A1 Apr. 5, 2012

Related U.S. Application Data

(63) Continuation-in-part of application No. 13/194,989, filed on Jul. 31, 2011, now Pat. No. 8,297,990.

(30) Foreign Application Priority Data

Sep. 30, 2010 (CN) ..... 2010 1 0299583
Dec. 9, 2010 (CN) ..... 2010 1 0580104

(51) Int. Cl.
*H01R 13/44* (2006.01)

(52) U.S. Cl. ..... 439/137

(58) Field of Classification Search ..... 439/135–137, 439/140, 145
See application file for complete search history.

(56) References Cited

U.S. PATENT DOCUMENTS

| | | | | |
|---|---|---|---|---|
| 6,998,945 | B2 * | 2/2006 | Huang et al. | 335/18 |
| 7,019,952 | B2 * | 3/2006 | Huang et al. | 361/42 |
| 7,195,500 | B2 * | 3/2007 | Huang et al. | 439/107 |
| 7,265,956 | B2 * | 9/2007 | Huang | 361/42 |
| 7,289,306 | B2 * | 10/2007 | Huang et al. | 361/42 |
| 7,295,415 | B2 * | 11/2007 | Huang et al. | 361/107 |
| 7,315,227 | B2 * | 1/2008 | Huang et al. | 335/6 |
| 7,317,600 | B2 * | 1/2008 | Huang et al. | 361/42 |
| 7,411,766 | B1 * | 8/2008 | Huang et al. | 361/42 |
| 7,455,538 | B2 * | 11/2008 | Germain | 439/137 |
| 7,538,993 | B2 * | 5/2009 | Huang et al. | 361/42 |
| 7,576,959 | B2 * | 8/2009 | Huang et al. | 361/42 |
| 7,633,726 | B2 * | 12/2009 | Huang et al. | 361/42 |
| 7,645,148 | B2 * | 1/2010 | Carbone et al. | 439/137 |
| 7,645,149 | B2 * | 1/2010 | Carbone et al. | 439/137 |
| 7,833,030 | B1 * | 11/2010 | Huang | 439/137 |
| 7,859,368 | B2 * | 12/2010 | Huang et al. | 335/18 |
| 7,883,346 | B2 * | 2/2011 | Huang | 439/140 |
| 7,887,346 | B1 * | 2/2011 | Huang | 439/140 |
| 7,934,935 | B1 * | 5/2011 | Gao | 439/137 |
| 7,985,085 | B2 * | 7/2011 | Gao | 439/137 |
| 8,007,296 | B2 * | 8/2011 | Chen et al. | 439/136 |
| 8,147,260 | B2 * | 4/2012 | Huang | 439/140 |
| 2006/0193092 | A1 * | 8/2006 | Huang et al. | 361/42 |
| 2006/0238933 | A1 * | 10/2006 | Huang et al. | 361/42 |
| 2006/0274463 | A1 * | 12/2006 | Huang et al. | 361/42 |
| 2006/0279886 | A1 * | 12/2006 | Huang et al. | 361/42 |
| 2007/0014068 | A1 * | 1/2007 | Huang et al. | 361/115 |

(Continued)

FOREIGN PATENT DOCUMENTS

CN 2476889 Y 2/2002

*Primary Examiner* — Ross Gushi
(74) *Attorney, Agent, or Firm* — Mei & Mark LLP

(57) ABSTRACT

A power outlet comprises an enclosure with a plug jack, a reset button comprising an extension arm, a transition contour on the extension arm and at least one safety shield configured to selectively block at least a portion of the plug jack. The safety shield comprises an outer wall and a pin groove. A shield latch comprises a travel section configured to elastically contact the extension arm, a stop section in contact with the safety shield, the stop section comprising a convex pin, and a self-reset mechanism. When the extension arm is in an upward position, the travel section presses against it, and when the extension arm is in a downward position, the travel section has a buffer space. When the travel section presses against the extension arm, the convex pin presses against the outer wall to lock the safety shield.

16 Claims, 10 Drawing Sheets

U.S. PATENT DOCUMENTS

2007/0041134 A1* 2/2007 Huang et al. ..... 361/42
2007/0049077 A1* 3/2007 Germain ..... 439/135
2007/0076337 A1* 4/2007 Huang ..... 361/42
2007/0086127 A1* 4/2007 Huang ..... 361/42
2008/0094765 A1* 4/2008 Huang et al. ..... 361/42
2009/0091869 A1* 4/2009 Huang et al. ..... 361/42
2009/0227130 A1* 9/2009 Carbone et al. ..... 439/137
2010/0073178 A1* 3/2010 Huang et al. ..... 340/664
2010/0159722 A1* 6/2010 Chen ..... 439/137
2010/0317207 A1* 12/2010 Huang ..... 439/137
2010/0317209 A1* 12/2010 Huang ..... 439/140
2011/0092085 A1* 4/2011 Gao ..... 439/137
2011/0092086 A1* 4/2011 Gao ..... 439/137
2011/0104918 A1* 5/2011 Chen et al. ..... 439/136
2011/0211283 A1* 9/2011 Huang et al. ..... 361/42
2011/0273803 A1* 11/2011 Huang ..... 361/42
2011/0273813 A1* 11/2011 Huang ..... 361/170
2012/0081819 A1* 4/2012 Huang ..... 361/42
2012/0083142 A1* 4/2012 Huang ..... 439/135
2012/0149221 A1* 6/2012 Huang ..... 439/137
2012/0170159 A1* 7/2012 Huang ..... 361/42
2012/0187958 A1* 7/2012 Huang ..... 324/557

* cited by examiner

POWER OUTLET WITH SHIELD LOCKING MECHANISM

This application claims the benefit of priority of Chinese patent application numbers 201010580104.6 filed Dec. 9, 2010 and 201010299583.4 filed Sep. 30, 2010, both of which are incorporated by reference in their entirety. This application also claims priority to and is a continuation in part of U.S. patent application Ser. No. 13/194,989 entitled Leakage Protection Outlet, filed Jul. 31, 2011, the content of which is incorporated herein by reference in its entirety.

TECHNICAL FIELD

The present disclosure relates generally to power outlets with protection functions. More specifically, the disclosure relates to power outlets with plug shields and locking mechanisms for the plug shields.

BACKGROUND

The existing technology contains two forms of power outlets. For one form, both the left and the right jacks are I-shaped. For the other form, the left jack is I-shaped and the right jack is T-shaped. Two examples of such power outlets are shown in incorporated by reference documents USPG-PUB 2010/0317207 published Dec. 16, 2010 entitled Power Outlet Socket Safety Shield Device and U.S. Pat. No. 7,833,030 published Nov. 16, 2010 entitled Safety Shield for Electrical Receptacles.

A power outlet according to the examples with a jack shielding device may include an enclosure with a middle-layer support provided in it, conductive plug bushes located below the middle-layer support, and the safety shield device. Guiding jacks are provided on the middle-layer support, corresponding to the positions of the conductive plug bushes. The safety shield device is used to plug the guiding jacks on the middle-layer support and the conductive plug bushes below. The safety shield device for double I-shaped jacks, e.g. the shield device in the Chinese utility model patent No. 200920223089.2, includes left shield, right shield, spring, base connected with the middle-layer support, etc. The safety shield device for left I-shaped and right T-shaped jacks, e.g. the shield device publicized in Chinese utility model patent No. 200920167808.3, includes left shield, right shield, the first spring used for resetting of left and right shields, small shield used for plugging the T-shaped hole, the second spring used for resetting the small shield and its reset mechanism, base connected fixedly with the middle-layer support, etc. When a plug is inserted into the shields, the two shield units are staggered, exposing the conductive plug bush below them. When the plug is pulled out, the shield units, under the action of springs, close the conductive plug bush. The shields need to cooperate with the locking mechanism to realize the function of plugging the conductive plug bushes. The problem to be resolved by this invention is to provide a shield locking mechanism which is simple in structure and acts reliably.

SUMMARY

In view of the above technical problems, the inventor provides a power outlet with a shield locking mechanism. Its locking structure is simple and has excellent action reliability.

A power outlet, comprises an enclosure with at least one plug jack, a reset button comprising an extension arm, the extension arm comprising a transition contour, and at least one safety shield configured to selectively block at least a portion of the plug jack. The safety shield comprises an outer wall comprising a pin groove. A self-resetting shield latch comprises a travel section configured to elastically contact the extension arm, a stop section in contact with the safety shield, the stop section comprising a convex pin, and a self-reset mechanism.

The travel section of the shield latch is configured to selectively press against the extension arm when the extension arm is in an upward position and to provide a buffer space between the safety shield and the extension arm when the extension arm is in a downward position. When the travel section presses against the extension arm, the convex pin presses against the outer wall and the safety shield is in a locked position. When the extension arm is in a downward position, the self-reset mechanism moves the shield latch toward the reset button and the convex pin aligns with the pin groove to unlock the safety shield.

The following are examples of beneficial effects are provided: In the case of mistaken wiring, the mechanisms can effectively block the movement of the fixed shield and the locking mechanism, thereby preventing an electroshock accident caused by abnormal insertion and ensuring safe usage. The locking mechanism also provides a reset button extension arm with buffer space, effectively preventing damage to the shield latch caused by ejection of the reset button when the plug is not pulled out. The locking mechanism operates stably and acts reliably.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Figure 1:
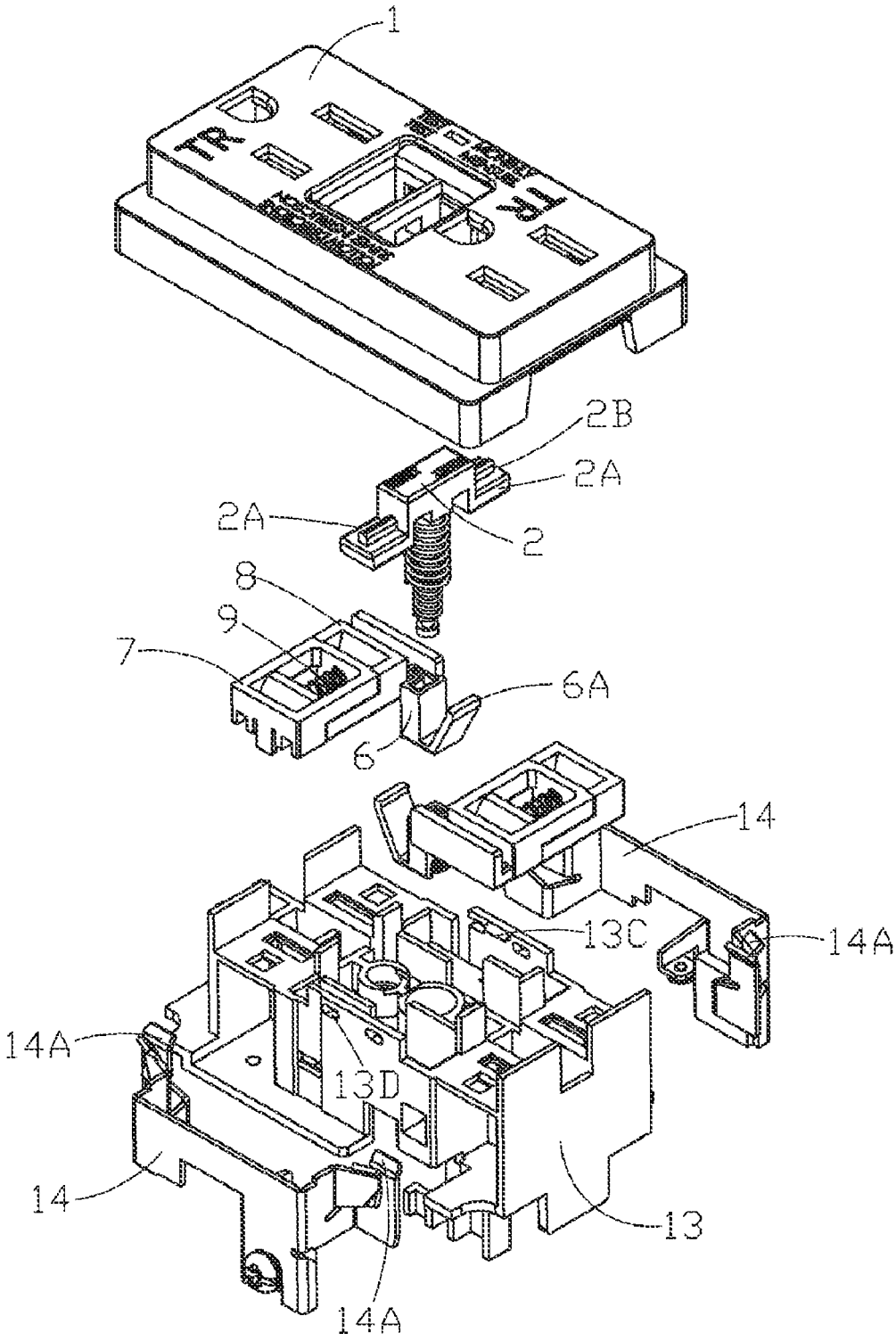
FIG. 1 is an exploded structural diagram of Example 1.
Figure 2:
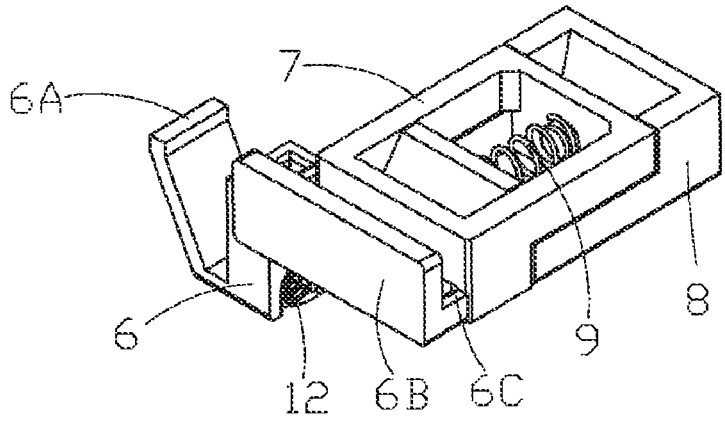
FIG. 2 is a structural diagram of the safety shield device and shield latch in Example 1.
Figure 3:
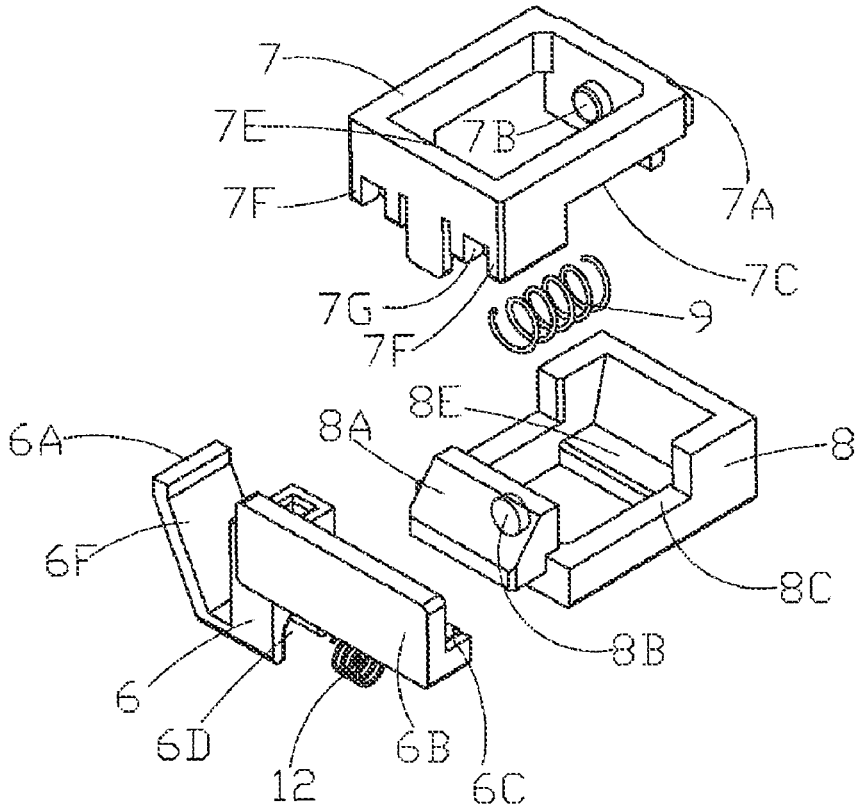
FIG. 3 is a structural diagram of the safety shield device and shield latch in Example 1.
Figure 4:
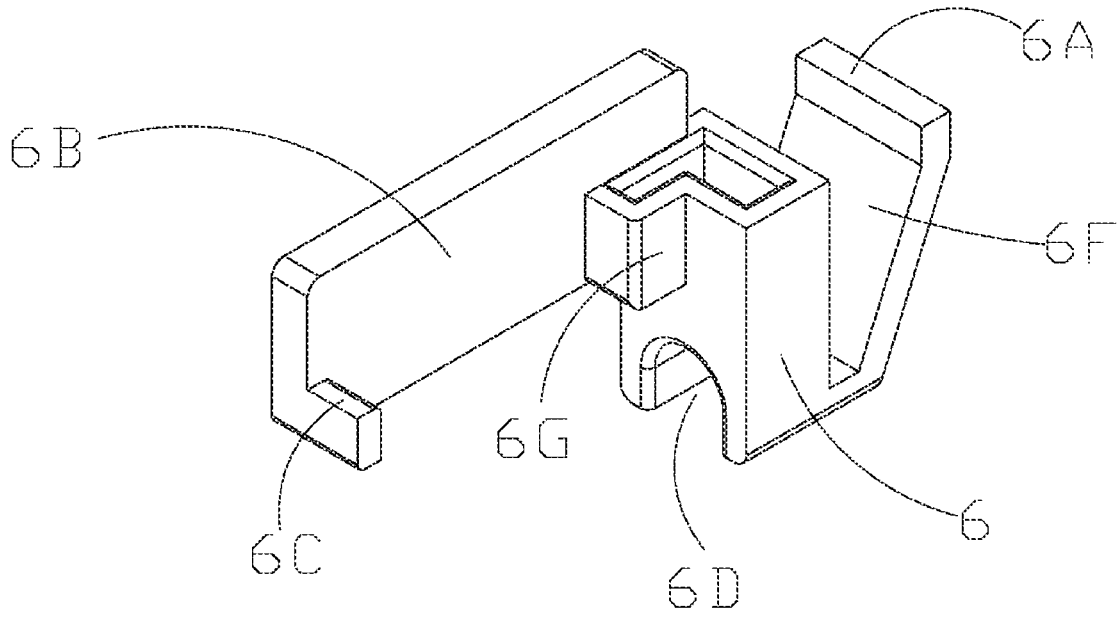
FIG. 4 is a structural diagram of the shield latch of Example 1 in another view.

Reference will now be made in detail to the present exemplary embodiments, examples of which are illustrated in the accompanying drawings. Wherever possible, the same reference numbers will be used throughout the drawings to refer to the same or like parts.

Example 1

Referring to FIGS. 1-6, the example shows a power outlet with the jacks both being I-shaped holes. The power outlet with shield locking mechanism includes an enclosure (which includes an upper cover and a base, with only upper cover 1 shown in FIG. 1), reset button 2 with extension arm 2B, and jack safety shield device composed of left shield 7, right shield 8 and shield reset spring 9. Middle-layer support 13 and conductive metal sheet 14 are provided in the enclosure. The conductive metal sheet is provided with conductive plug bushes 14A. Guiding jacks corresponding to the position of conductive plug bushes 14A are provided on middle-layer support 13. When the guiding jacks are exposed, the conductive plug bushes 14A are also exposed. The jack safety shield device is also provided with a shield locking mechanism linked with the reset button 2.

Locking step 7E and locking step 8E are flat surfaces that prevent a plug pin, or other inserted object, from contacting conductive plug bushes 14A when the left shield 7 and right shield 8 are locked. Because the left shield 7 and the right shield 8 have locking step 7E and locking step 8E respectively, only when both the left and the right shields are braced open by the plug can the conductive plug bushes below be exposed. Therefore, insertion of foreign objects, or insertion of a plug during a fault condition, into the conductive plug bushes can be avoided as long as at least one shield is provided with a locking step.

In one example, the power outlet has two groups of jacks. The right shield 8 of the safety shield device of the first group of jacks is provided with a locking mechanism. The left shield 7 of the safety shield device of the second group of jacks is provided with a locking mechanism. Using the shield locking mechanism of the second group as an example: The shield locking mechanism includes reset button extension arm 2B and self-resettable shield latch 6. The shield latch 6 includes travel section 6A in contact with reset button extension arm 2B and stop section 6B in contact with the shield 7. The reset button extension arm 2B has a transition contour 2A. The transition contour 2A can be a sloped or curved surface, or a combination where two perpendicular planar surfaces are joined by a sloped surface. The place where travel section 6A contacts with reset button extension arm 2B is retractable elastically.

Stop section 6B has a positioning convex pin 6C. The outer wall of the adjoining shield has positioning groove 7G to match positioning convex pin 6C. When reset button extension arm 2B contacts with shield latch travel section 6A, positioning convex pin 6C on the shield latch pushes against the outer wall 7F of the left shield 7, and the left shield 7 is locked.

When reset button extension arm 2B lowers and separates from shield latch travel section 6A, under the action of the self-reset mechanism, i.e. spring 12, the shield latch 6 moves toward the reset button, and the positioning convex pin 6C on the shield latch lock section corresponds to the positioning groove 7G on the outer wall of the left shield. The positioning groove 7G of the outer wall of the left shield can slide along the positioning convex pin 6C on the shield latch lock section. The left and right shields 7, 8 can then move transversely, and are allowed to open.

The shield latch self-reset mechanism of this example includes spring seat 6D located at the bottom of the travel section and travel reset spring 12 provided in the spring seat 6D. The other end of the travel reset spring 12 pushes against a fixed position in the enclosure. At the position of the shield latch travel section 6A facing the reset button extension arm 2B, an elastic bending arm is extended out. The elastic bending arm can be V-shaped or U-shaped. The free end of the elastic bending arm 6F contacts with the reset button extension arm 2B. The pushing force of the elastic bending arm 6F is larger than that of the travel reset spring 12. The elastic bending arm is designed to provide the reset button extension arm with buffer space when the reset button extension arm is in a particular position. Because the user may start a test and press the test button to make the reset button eject when the plug is not pulled out, if the shield latch rigidly contacts the reset button extension arm, the shield latch may be damaged. With the V-shaped arm provided, even if the plug is not pulled out, the reset button can still eject smoothly, and the elastic bending arm of the shield latch travel section 6A is compressed. After the plug is pulled out, the left and right shields close under the action of shield reset spring 9. And, under the action of the elastic bending arm, the latch returns to the state that positioning convex pin 6C pushes against the outer wall of the left shield 7, and the left shield 7 is locked.

Shield latch travel section 6A and stop section 6B are formed integrally. Spring seat 6D is provided at the part of travel section 6A extending beyond the lower end face of stop section 6B. Travel section 6A has stripping holes. In this way, it can save material, prevent deformation of the travel section, and prolong the service life effectively. Stop section 6B is plate-shaped. When the shields are locked, the outer side face of the shield is located at a certain distance from the inner side face of stop section 6B. The outer side 7F of the shield abuts with positioning convex pin 6C. Positioning convex pin 6C is located on stop section 6B, for example, at an effective position at the end or in the middle. A positioning step 6G is provided at the connection between travel section 6A and stop section 6B. The positioning step 6G is flush with the end face of the stop section positioning convex pin 6C. When the shield is locked, the outer wall of the shield 7 contacts with the positioning step 6G and the positioning convex pin 6C respectively. To make the structure compact and for stable operation of the shield latch, the outer face of the plate-shaped stop section 6B of the said shield latch abuts with the inner edge of the lower frame of the upper cover 1.

Figure 5:
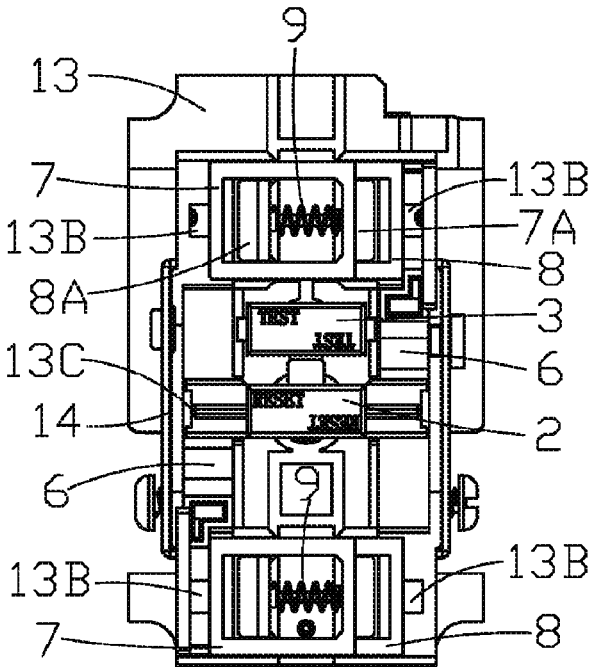
FIG. 5 is a diagram of Example 1 with the shield in a locked state (with the upper cover removed).
Figure 6:
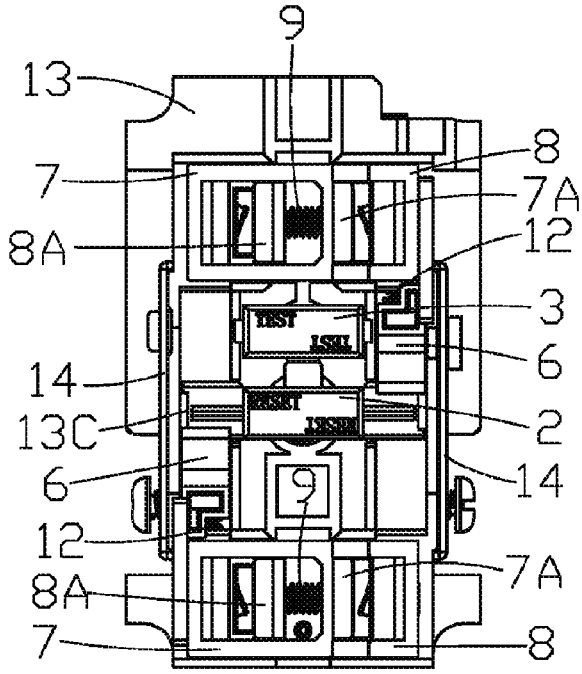
FIG. 6 is a diagram of Example 1 with the shield in an unlocked state (with the upper cover removed).
Figure 7:
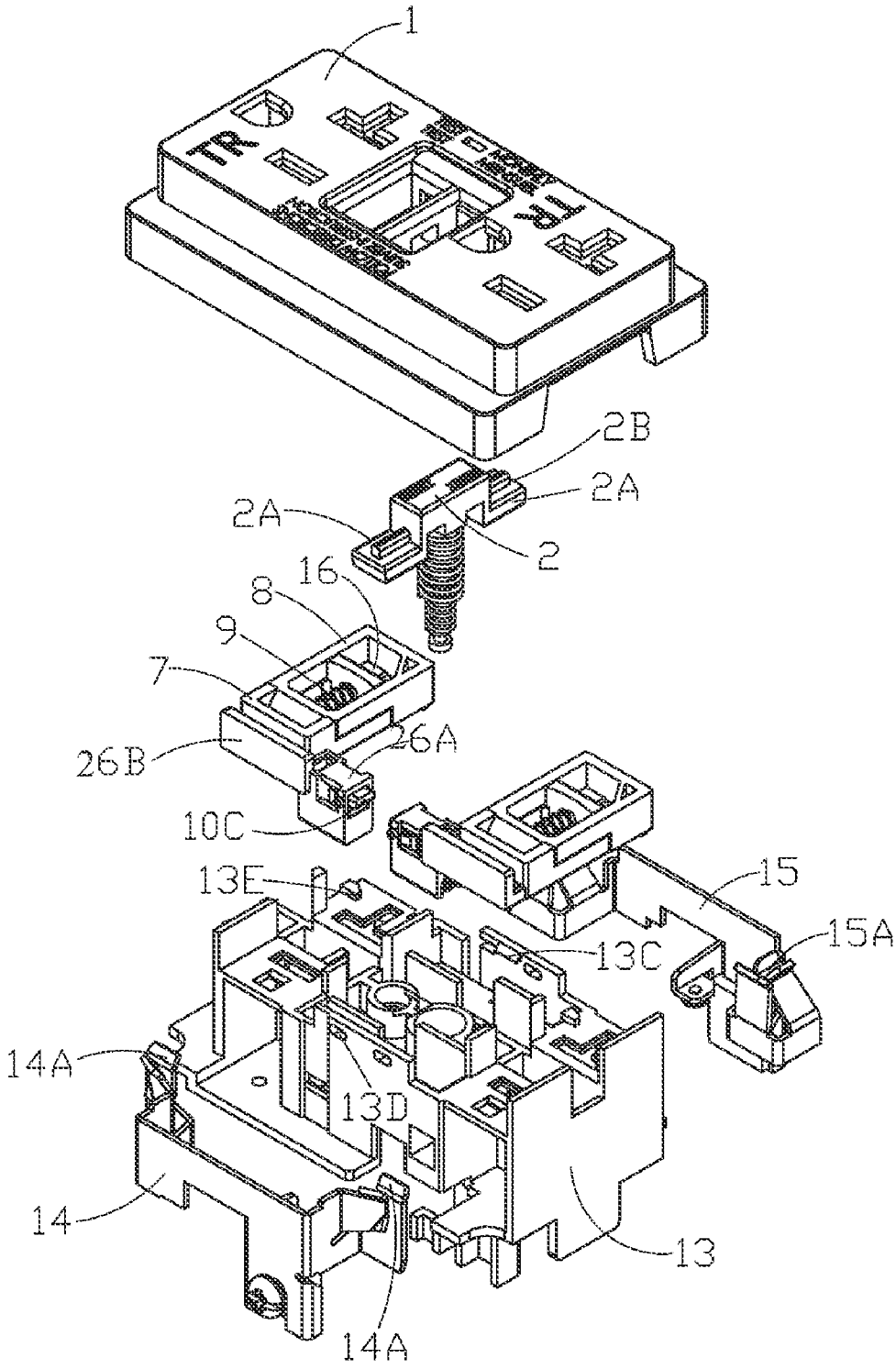
FIG. 7 is an exploded structural diagram of Example 2.
Figure 8:
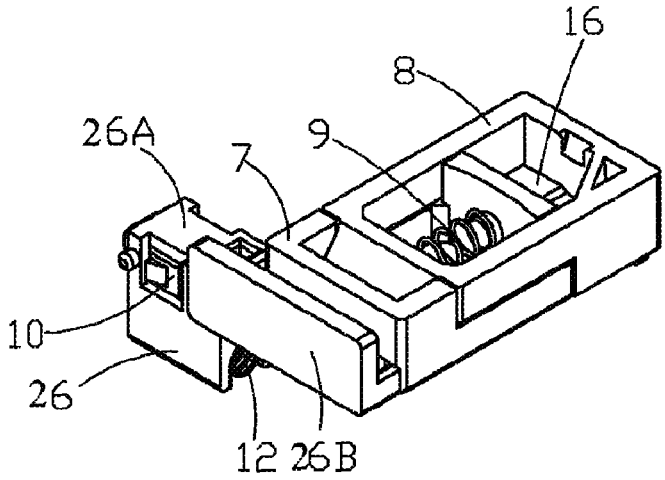
FIG. 8 is a structural diagram of the safety shield device and shield latch in Example 2.
Figure 9:
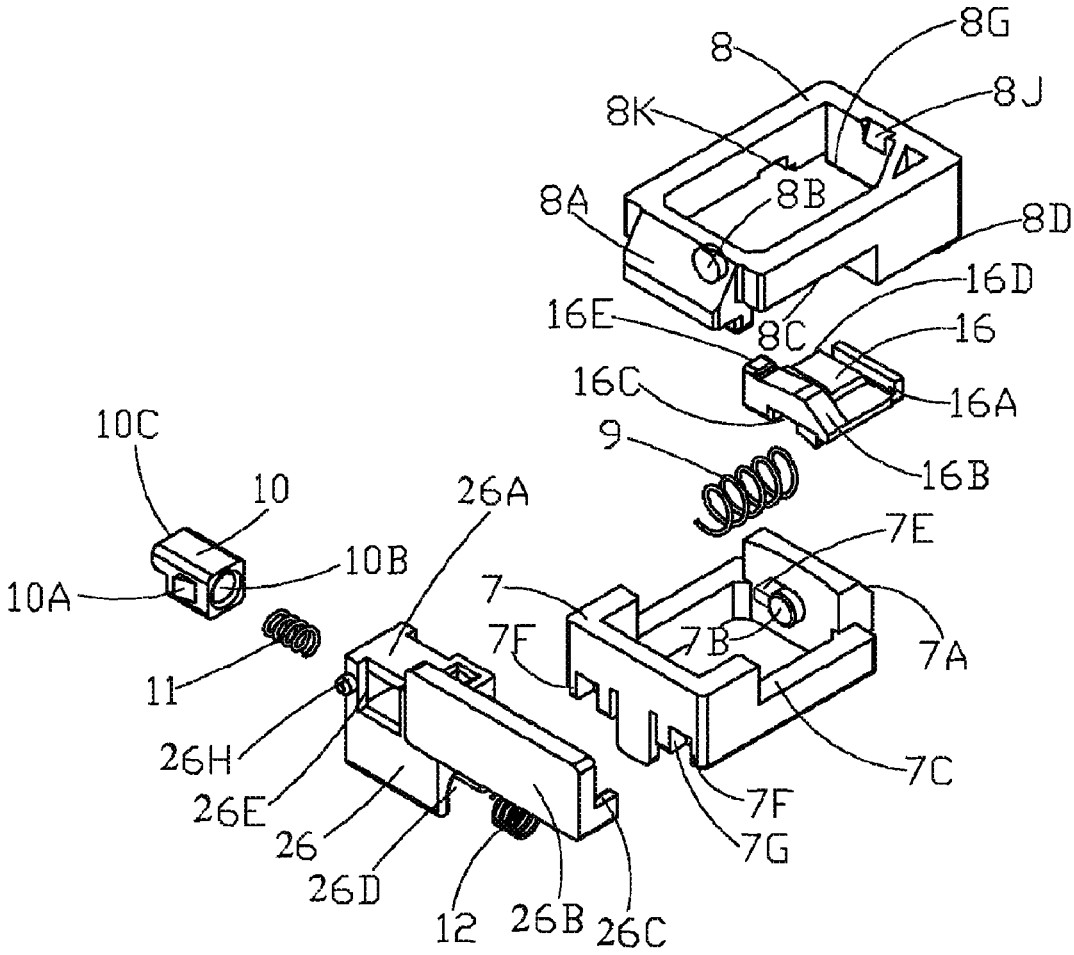
FIG. 9 is a structural diagram of the safety shield device and shield latch in Example 2.

The action process is as follows: In an initial state such as a shipped state, reset button 2 is not pressed down. Reset button is in an uppermost position, and reset button extension arm 2B contacts with the V-shaped arm of the travel section of the shield latch. Since the pushing force of the elastic bending arm is larger than that of travel reset spring 12, travel reset spring 12 is compressed, positioning convex pin 6C contacts with the outer side face 7F of the left shield 7, and the left shield 7 is locked. Referring to FIG. 5, when reset button 2 is pressed down, and no fault, failure, or reverse wire conditions exist, reset button extension arm 2B lowers and separates from the transition contour of shield latch travel section 6A. Shield latch 6, under the action of travel reset spring 12, moves away from the reset button. When the maximum downward stroke is achieved, positioning convex pin 6C arrives at the position corresponding to the groove 7G in the outer side face of the left shield 7, as shown in FIG. 6. At this time, the left and right shields 7, 8 are unlocked and the middle-layer support guiding jacks and conductive plug bushes are accessible to accept plug pins. That is, when a user inserts an appliance's plug pins in to the power outlet the plug pins slide along the slopes 7A and 8A, which slides the locking steps 7E and 8E out of the way. The plug pins can then pass through the guiding jacks and into the plug bushes. When the user stops pressing the reset button, it rises up slightly from a biasing force, which can be from one or more springs surrounding a stem beneath the button. The device is now in a reset state.

When the power outlet is in a reset state, the left shield 7 and right shield 8 cover the guiding jacks and conductive plug bushes. The spring force from shield reset spring 9 can maintain the left shield 7 and right shield 8 in a position to cover the guiding jacks and conductive bushes until appropriate plug pins interface with the slopes 7A and 8A to brace the left shield 7 and right shield 8 apart. Other objects such as hairpins or keys, will not allow the bracing of the left shield 7 and the right shield 8, and the conductive plug bushes and guiding jacks will be protected from the other objects. The reset button 2 is configured to rise all the way up and to indicate a faulty circuit when a fault occurs.

If a condition such as a reverse wire condition or end-of-life status condition occurs, the reset button 2, after being pressed, rises all the way up and the extension arm 2B moves in to the position for locking the shields. Neither foreign objects nor plug pins can enter the plug bushes. And, the device can be configured so that the device cannot be reset until the fault is cleared. Or, in the case of end-of-life of a component part, the device can be configured so that the device cannot be reset by pressing the reset button.

In the preferred embodiment, if there is no electricity or no current through the GFCI device, such as when the device is in a reverse-wired condition, the reset button 2 is in a position to prevent the shields from moving, thus preventing plug pins from entering into the sockets. Only after the GFCI device is reset can the plug pins be inserted in to the sockets. Therefore, the reset button interfaces with tripping and resetting mechanisms such as latches, springs, levers, guide plates or posts, pins, bangers or other mechanisms known in the art for tripping or resetting functions. The outlet also comprises detection circuitry for detecting one or more of a ground fault, arc fault, reverse wire condition, un-resettable circuit condition such as a burnt out circuit, or other overcurrent or undercurrent condition. Appropriate hardware such as a solenoid, comparator, silicon controlled rectifier, integrated circuit, resistor, capacitor, circuit board, wiring or other known mechanisms for effectuating the detection of the above conditions may be included in the outlet.

More specifically, the leakage protection outlet can include an upper cover with jacks, an intermediate bracket, a base, a power input end, a power output end, a reset button provided on the upper cover, a reset mechanism for connecting the power input end and the power output end when the reset button is pressed, an electromagnetic tripping mechanism for disconnecting the power input end and the power output end when leakage current appears, etc. A pair of conductors leading from the power output end is provided with at least one pair of conductive plug bushes, which correspond to the positions of the jacks on the upper cover. This pair of conductors is also provided with a pair of static contacts. A pair of conductors leading from the power input end is provided with a pair of moving contacts. When the reset button has been pressed, it can reset and drive the moving contacts to lift up and to connect with the static contacts. The conductive plug bushes are thereby electrified. The tripping mechanism can be arranged with actuating members to release the reset button, and springs or other lifting mechanisms, can cause the reset button to rise up under a fault or other adverse condition. For the specific structure and movement process, refer to the Chinese utility model patent application No. 01226819.4, which is incorporated herein by reference.

The leakage protection outlet can also comprise the shields and shield locking mechanisms, and an electromagnetic tripping mechanism. Reset button locking mechanisms can include a lock latch, a lock latch keeper, and a reset lock spring. The reset button can be linked to the reset locking mechanisms and can be configured to connect the power input end and the power output end together when the reset button has been pressed down to reset. The electromagnetic tripping mechanism is configured to disconnect the power input end from the power output end in response to a leakage current and to release the reset button for it to rise up. The lock latch can comprise a first end and a second end which rest upon the shields and the reset button extension arm respectively. Additional description of the reset button locking and activation mechanisms can be found in U.S. patent application Ser. No. 13/949,989 filed Jul. 31, 2011 for a Leakage Protection Outlet, incorporated herein by reference.

Example 2

Referring to FIGS. 7-11, the example is directed to a power outlet with I-shaped jacks on the left and T-shaped jacks on the right. In the enclosure, middle-layer support 13, conductive metal sheet 14 and conductive metal sheet 15 are provided. Conductive metal sheet 14 is provided with I-shaped conductive plug bush 14A. Conductive metal sheet 15 is provided with T-shaped conductive plug bush 15A. Middle-layer support 13 is provided with guiding jacks corresponding to the positions of I-shaped conductive plug bush 14A and T-shaped conductive plug bush 15A. When the guiding jacks are exposed, the conductive plug bushes are also exposed. In this example, the jack safety shield device includes left shield 7, right shield 8 and small shield 16. Small shield 16 is located below right shield 8. Left shield 7 is provided with shield locking mechanism. Shield latch travel section 26A and stop section 26B are formed integrally. Spring seat 26D is provided at the part of travel section 26A extending beyond the lower end face of stop section 26B. The structure of the travel section in this example is different.

Travel section 26A has a cavity with an opening at the end. In the cavity, buffer tongue 10 is provided with its front end capable of extending out of the opening of the cavity. At the side of buffer tongue 10, there is a guiding slide block 10A. On travel section 26A, a guiding groove 26E is provided to match guiding slide block 10A. At the rear end of buffer tongue 10, a buffer spring seat 10B is provided. Inside buffer spring seat 10B, there is buffer tongue reset spring 11. The pushing force of buffer tongue reset spring 11 is larger than that of travel reset spring 12. The front end of buffer tongue 10 has a transition contour 10C in contact with reset button extension arm 2B. Reset button extension arm 2B is also provided with transition contour 2A. The transition contours 10C and 2A can take the shape of a curve, slope or ramp and can include perpendicular surfaces that are interposed by a slope or ramp shape. Therefore, when the plug is not pulled out of the socket before the reset button trips in an upward direction, the reset button extension arm can still allow the transition contour to rise slowly without damaging the shield latch.

To facilitate assembly, at least one side of travel section 26A of the shield latch is provided with positioning pin 26H. Middle-layer support 13 is provided with positioning slide groove 13D to match positioning pin 26H of the shield latch travel section. The matching structure of the positioning pin and the positioning slide groove can prevent effectively the shield latch from shaking up and down, ensuring the stable operation of the shield latch. To ensure further the stable operation of the shield latch, middle-layer support 13 is also provided with hook 13C. The lower end face of hook 13C and the upper end face of reset button extension arm 2B cooperate to function for positioning the reset button. The hook 13C restricts the upward motion of the reset button. Meanwhile, the technical problem of assembly difficulty is also resolved.

The action process is as follows: In the initial state, reset button is not pressed down and is able to travel upward via a spring force on the reset button, and reset button extension arm 2B contacts with travel section buffer tongue 10 of the shield latch. Since the pushing force of buffer tongue 10 is larger than that of travel reset spring 12, travel reset spring 12 is compressed. Positioning convex pin 26C contacts the outer side face 7F of left shield 7, and left shield 7 is locked.

Figure 10:
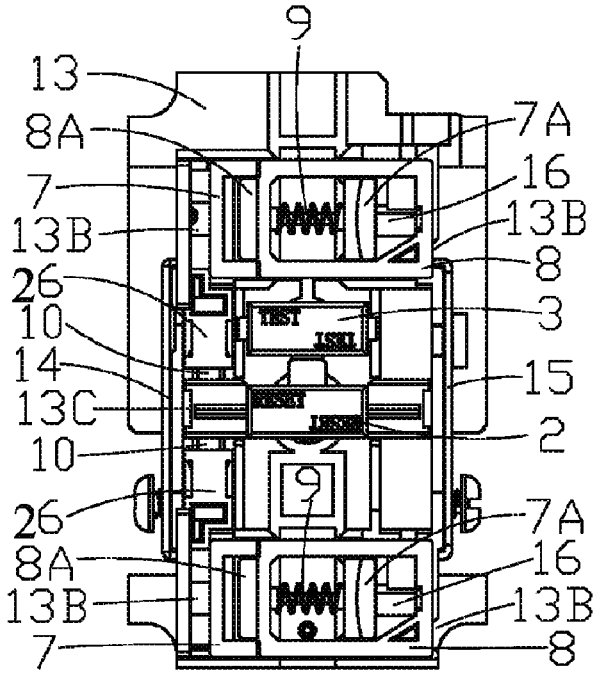
FIG. 10 is a structural diagram of Example 2 with the shield in a locked state (with the upper cover removed).
Figure 11:
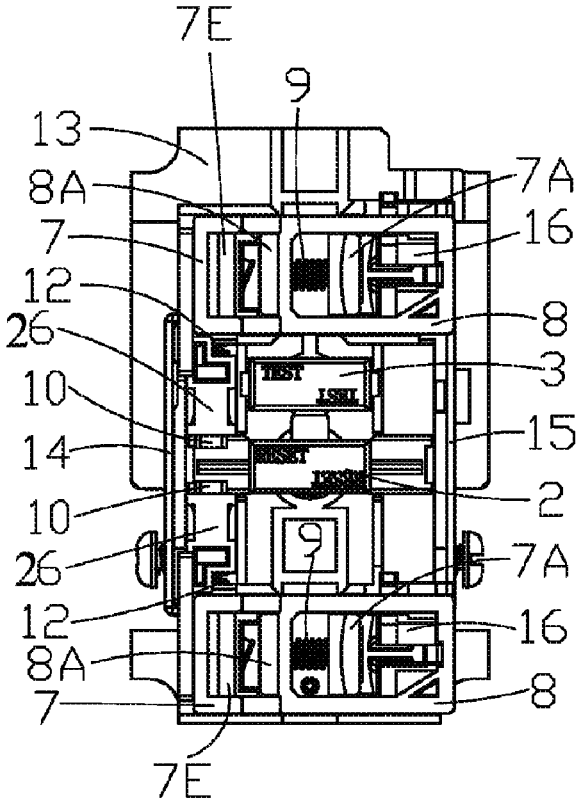
FIG. 11 is a structural diagram of Example 2 with the shield in an unlocked state (with the upper cover removed).
Figure 12:
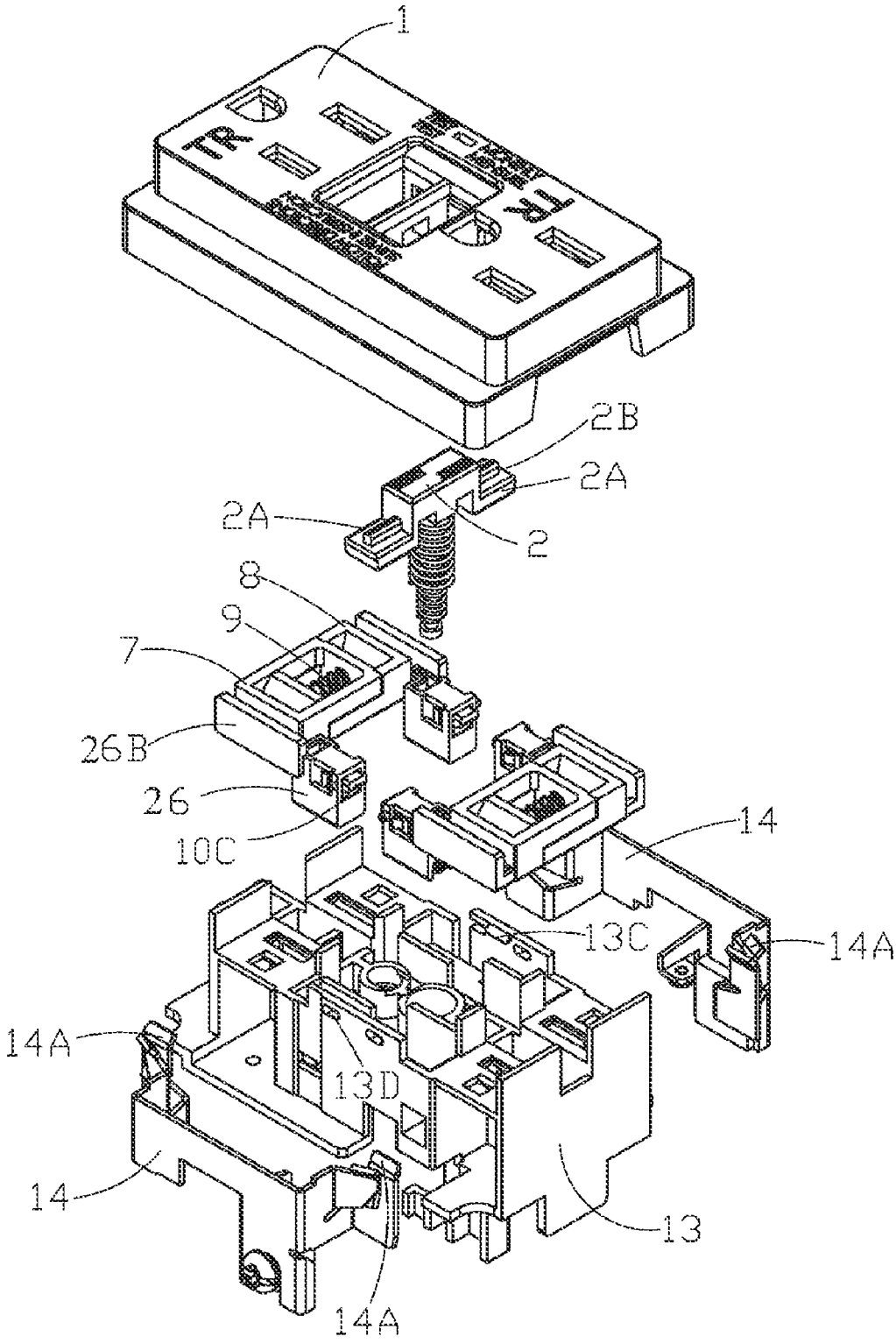
FIG. 12 is an exploded structural diagram of Example 3.
Figure 13:
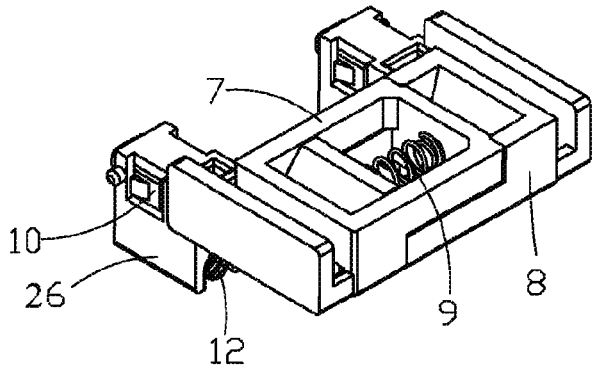
FIG. 13 is a structural diagram of the safety shield device and shield latch in Example 3.
Figure 14:
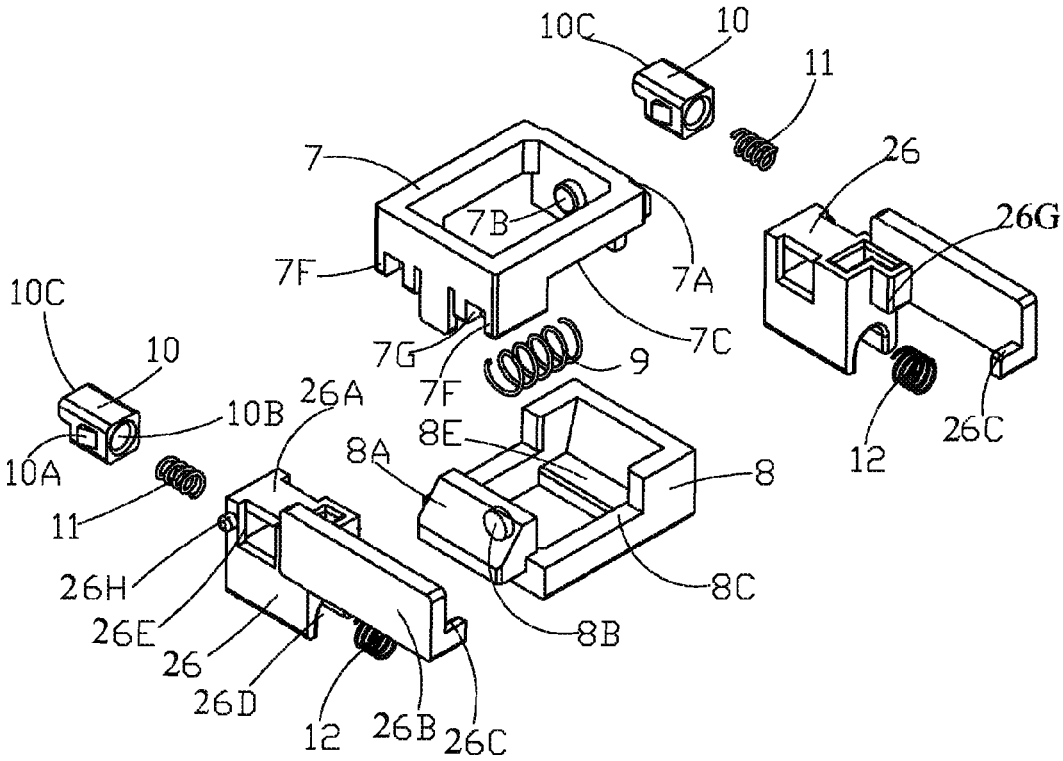
FIG. 14 is a structural diagram of the safety shield device and shield latch in Example 3.

Referring to FIG. 10, when reset button 2 is pressed down, reset button extension arm 2B lowers and separates from the head transition contour 10C of buffer tongue 10 of the shield latch travel section. Under the action of travel reset spring 12, shield latch 26 moves away from the reset button. When the maximum stroke is achieved, positioning convex pin 26C arrives at the position corresponding to groove 7G in the outer side face of the left shield 7, as shown in FIG. 11. At this time, the guiding jacks in middle-layer support 13 and the conductive plug bushes are exposed.

Example 3

Figure 15:
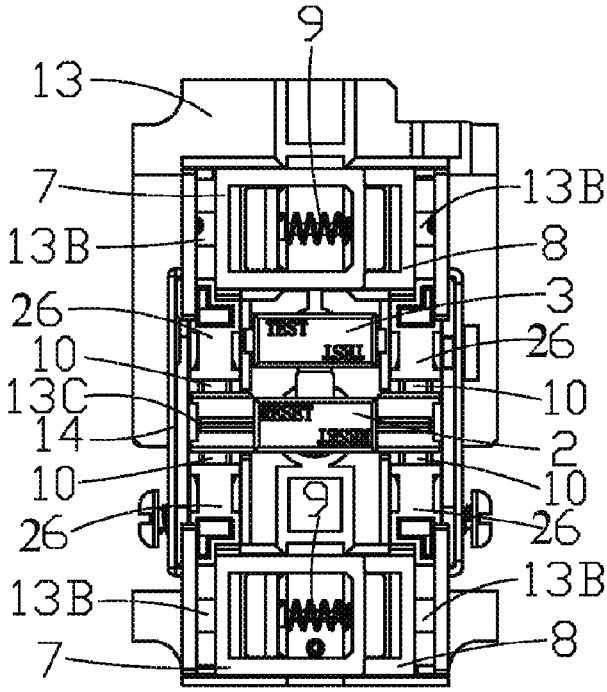
FIG. 15 is a structural diagram of Example 3 with the shield in a locked state (with the upper cover removed).
Figure 16:
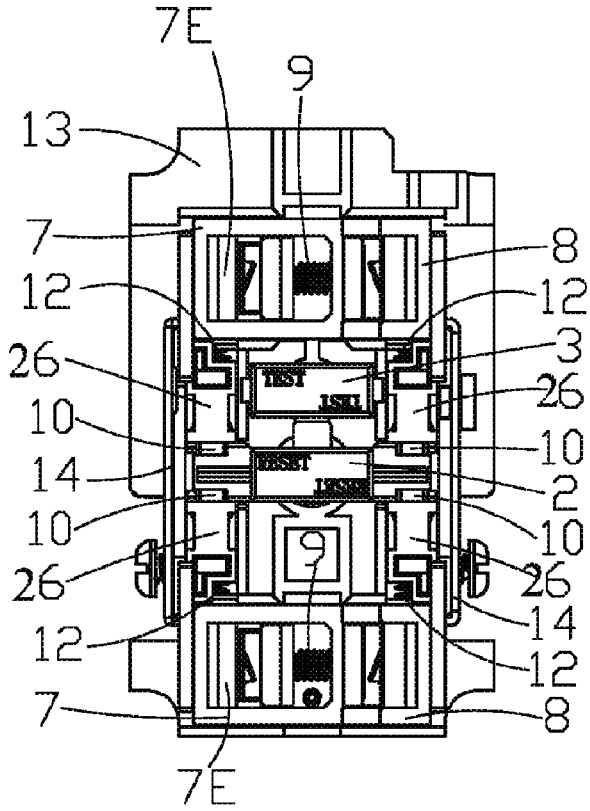
FIG. 16 is a structural diagram of Example 3 with the shield in an unlocked state (with the upper cover removed).

Referring to FIGS. 12-16, this example is also directed at the power outlet with double I-shaped jacks. Each of the left and right shields is provided with a group of shield locking mechanisms to ensure more stable operation. Each of left shield 7 and right shield 8 is provided with a group of shield locking mechanisms. The travel section of the shield latch contacts with the extension arms 2A on the two sides of the reset button 2 respectively. The locked state of the shields is as shown in FIG. 15, and the unlocked state of the shields is as shown in FIG. 16. In this way, neither the left shield nor the right shield can be braced open when being locked. The structure of the shield locking mechanism is the same as that of Example 2. The shield locking mechanisms can also take the form of Example 1 so that each of the left and right shields has the locking mechanisms shown in Example 1.

Although this invention has been illustrated and described through the referenced preferable examples, the normal technicians of this domain shall understand that various modifications can be made in forms and details within the scope of the claim without being limited by the descriptions of the above examples.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A power outlet, comprising:

an enclosure with at least one plug jack;

a reset button comprising an extension arm, the extension arm comprising a transition contour;

at least one safety shield configured to selectively block at least a portion of the plug jack, the safety shield comprising an outer wall comprising a pin groove; and a self-resetting shield latch comprising:

a travel section configured to elastically contact the extension arm;

a stop section in contact with the safety shield, the stop section comprising a convex pin; and a self-reset mechanism, wherein:

the travel section of the shield latch is configured to selectively press against the extension arm when the extension arm is in an upward position and to provide a buffer space between the safety shield and the extension arm when the extension arm is in a downward position, when the travel section presses against the extension arm, the convex pin presses against the outer wall and the safety shield is in a locked position, and when the extension arm is in a downward position, the self-reset mechanism moves the shield latch toward the reset button and the convex pin aligns with the pin groove to unlock the safety shield.

2. The power outlet of claim 1, wherein the self-reset mechanism comprises a spring seat beneath the travel section and a travel reset spring in the spring seat, wherein a first end of the travel reset spring presses against a wall of the spring seat and a second end of the travel reset spring presses against the enclosure.

3. The power outlet of claim 2, wherein:

the travel section further comprises an elastically bendable arm extending away from the shield lock and towards the extension arm, the bendable arm contacts the extension arm when the extension arm is in the upward position, and the bendable arm has a spring force that is greater than a spring force of the travel reset spring.

4. The power outlet of claim 3, wherein:

stop section is plate-shaped and further comprises a lower end face and a positioning step, at least a portion of the travel section extends beyond the lower end face, and the spring seat is provided in the portion of the travel section extending beyond the lower end face, the travel section and the stop section are integrally formed and interface at a connection, the positioning step is provided at the connection between the travel section and the stop section and the positioning step is flush with the convex pin, and when the safety shield is in a locked position, the outer wall of the safety shield contacts the positioning step and the convex pin.

5. The power outlet of claim 4, wherein:

the enclosure further comprises a middle layer support, the middle layer support further comprises a positioning groove, the shield latch further comprises a positioning pin in at least one side, and the positioning pin is configured to slide in the positioning groove.

6. The power outlet of claim 3, wherein:

the enclosure further comprises a middle layer support, the middle layer support further comprises a positioning groove, the shield latch further comprises a positioning pin in at least one side, and the positioning pin is configured to slide in the positioning groove.

7. The power outlet of claim 2, wherein the enclosure further comprises:

at least one socket;

a base;

a middle layer support configured to support the shield latch, the safety shield and the reset button; and an upper cover with a lower frame, the lower frame comprising an inner edge, wherein an outer face of the stop section abuts the inner edge.

8. The power outlet of claim 7, wherein:

the middle layer support further comprises a positioning groove, the shield latch further comprises a positioning pin in at least one side, and the positioning pin is configured to slide in the positioning groove.

9. The power outlet of claim 8, wherein the middle layer support further comprises a positioning hook with a lower end, and the lower end is configured to abut an upper end face of the extension arm.

10. The power outlet of claim 7, wherein the middle layer support further comprises a positioning hook with a lower end, and the lower end is configured to abut an upper end face of the extension arm.

11. The power outlet of claim 1, wherein:

the self-reset mechanism comprises a spring seat with a pushing force, the travel section and the stop section are integrally formed, the stop section further comprises a lower end face, at least a portion of the travel section extends beyond the lower end face, the spring seat is provided in the portion of the travel section that extends beyond the lower end face, the travel section further comprises:

a cavity;

a buffer tongue with a front end configured to selectively extend out of the cavity; and a guiding groove, the buffer tongue comprises:

a guiding slide block configured to interface with the guiding groove, a buffer spring seat in a rear end of the buffer tongue, a buffer tongue reset spring in the buffer spring seat, and a transition contour in a front end of the buffer tongue configured to contact the extension arm when the extension arm is in the upward position, and the buffer tongue reset spring has a greater pushing force than the pushing force of the travel reset spring.

12. The power outlet of claim 11, wherein:

the enclosure further comprises a middle layer support, the middle layer support further comprises a positioning groove, the shield latch further comprises a positioning pin in at least one side, and the positioning pin is configured to slide in the positioning groove.

13. The power outlet of claim 1, wherein the enclosure further comprises a middle layer support, the middle layer support further comprises a positioning hook with a lower end, and the lower end is configured to abut an upper end face of the extension arm.

14. The power outlet of claim 1, further comprising a right safety shield, wherein the at least one safety shield is a left safety shield, and the right safety shield and the left safety shield are selectively locked from motion and unlocked for motion by the shield latch.

15. The power outlet of claim 1, further comprising:

a right safety shield; and a second shield latch, wherein:

the second shield latch adjoins the right safety shield, the at least one safety shield is a left safety shield, the shield latch adjoins the left safety shield, the extension arm is configured to selectively press against both the shield latch and the second shield latch to selectively lock the right safety shield and the left safety shield from motion.

16. The power outlet of claim 1, further comprising:

a right safety shield; and a small shield, wherein:

the small shield is provided beneath the right safety shield, and the shield latch is provided outside the at least one safety shield.

* * * * *